US006719855B2

(12) United States Patent
Fukuda et al.

(10) Patent No.: US 6,719,855 B2
(45) Date of Patent: Apr. 13, 2004

(54) FE—CR—AL BASED ALLOY FOIL AND METHOD FOR PRODUCING THE SAME

(75) Inventors: Kunio Fukuda, Chiba (JP); Susumu Satoh, Chiba (JP); Kazuhide Ishii, Chiba (JP); Takeshi Fujihira, Chiba (JP); Akira Kawaharada, Chiba (JP)

(73) Assignee: JFE Steel Corporation (JP)

( * ) Notice: Subject to any disclaimer, the term of this patent is extended or adjusted under 35 U.S.C. 154(b) by 1 day.

(21) Appl. No.: 10/069,748

(22) PCT Filed: Jun. 25, 2001

(86) PCT No.: PCT/JP01/05384

§ 371 (c)(1),
(2), (4) Date: Feb. 27, 2002

(87) PCT Pub. No.: WO02/02836

PCT Pub. Date: Jan. 10, 2002

(65) Prior Publication Data

US 2002/0172613 A1 Nov. 21, 2002

(30) Foreign Application Priority Data

Jun. 30, 2000 (JP) ..... 2000-199384

(51) Int. Cl.[7] ..... C22C 38/067; C22C 38/18; C21D 8/00

(52) U.S. Cl. ..... 148/325; 148/608; 148/610; 148/642; 420/40; 420/62; 420/70; 428/606

(58) Field of Search ..... 148/325, 608, 148/610, 542; 420/40, 62, 70; 428/606

(56) References Cited

U.S. PATENT DOCUMENTS 5,228,932 A * 7/1993 Shimizu et al. ..... 148/603

5,476,554 A * 12/1995 Ishii et al. ..... 148/325

FOREIGN PATENT DOCUMENTS

JP 6-220587 * 8/1994 ..... C22C/38/00

* cited by examiner

*Primary Examiner*—Deborah Yee
(74) *Attorney, Agent, or Firm*—Piper Rudnick LLP

(57) ABSTRACT

The present invention provides an Fe—Cr—Al-based alloy for catalyst carriers and a foil thereof having a thickness of 40 μm or less, the alloy and the foil improved in the oxidation resistance at high temperatures and having excellent deformation resistance. Specifically, the present invention provides an Fe—Cr—Al-based alloy foil and a manufacturing method thereof, comprising 16.0 to 25.0 mass % of Cr, 1 to 8 mass % of Al, La, Zr, and the balance being Fe and incidental impurities. The contents by mass % of La and Zr meet the following ranges when the foil thickness thereof is t μm:

$$1.4/t \leqq La \leqq 6.0/t \quad (1)$$

$$0.6/t \leqq Zr \leqq 4.0/t \quad (2)$$

The Fe—Cr—Al-based alloy foil may further comprises Hf and the balance being Fe and incidental impurities, wherein the contents by mass % of La, Zr, and Hf meet the following ranges:

$$1.4/t \leqq La \leqq 6.0/t \quad (1)$$

$$0.4/t \leqq Zr \leqq 2.0/t \quad (3)$$

$$0.5/t \leqq Hf \leqq 2.0/t \quad (4).$$

13 Claims, 4 Drawing Sheets

FE— CR— AL BASED ALLOY FOIL AND METHOD FOR PRODUCING THE SAME

FIELD OF THE INVENTION

The present invention relates to an Fe—Cr—Al-based alloy foil having oxidation and deformation resistances at high temperatures and to a manufacturing method thereof. The alloy foil is suitable for catalytic converters for automotive exhaust gas purification, where the catalyst carriers and the catalytic converters are exposed to intense vibration and thermal shock in a high-temperature oxidizing atmosphere. The alloy foil is also useful for devices and apparatuses for combustion gas exhaust systems.

BACKGROUND ART

Replacing conventional ceramic catalytic converter carriers for automotive exhaust gas purification apparatuses with a metal honeycomb as disclosed in Japanese unexamined patent publication No. 56-96726 facilitates the miniaturization of catalytic converters and improves engine performance.

In view of environmental protection, it is required that automotive exhaust gas purification apparatuses be capable of starting a catalytic reaction immediately after the engine is started. A catalytic converter of the apparatus is located as near the combustion environment as possible so that high temperature exhaust gas can immediately reach the converter, and thus the catalytic converter reaches a catalytic activation temperature in a short period. In this case, the catalytic converter is exposed to thermal cycles of heating and cooling in a high-temperature range and engine judders, that is, it has been used in severe conditions. Ceramics conventionally used as a material for the catalytic converters are not suitable for practical use because they are easily damaged by thermal shock. Thus, oxidation-resistant metals such as Fe—Cr—Al-based alloys are used. An Fe—Cr—Al-based alloy exhibits oxidation resistance at high temperatures because easily oxidizable Al is oxidized prior to Fe to form an oxide film of $Al_2O_3$ which protects the alloy surface from the oxidation. After the consumption of Al in the alloy, Cr is preferentially oxidized at the interface between the $Al_2O_3$ oxide film and the alloy. Such Fe—Cr—Al-based alloys are disclosed in Japanese unexamined patent publication Nos. 56-96726 (mentioned above), 7-138710, 9-279310, etc.

As mentioned above, emission control is strengthened in view of environmental protection, the demand that exhaust gas be purified from the beginning of the engine start has been intensifying in these years. In order to comply with the control, the use of a metal carrier has been increasing, and the demand for thin foil thereof is intensifying. This is because a reduction in the wall thickness of the metal carrier allows exhaust back pressures to be reduced and allows the catalyst to be activated in a short period due to decreased heat capacity. However, the reduced foil thickness requires that materials for the foil have a higher oxidation resistance. Also, since the reduced foil thickness leads to deformation by heat, deformation resistance at high temperatures (less elongation at high temperatures and less fracture due to heat stress) is further required.

Conventional Fe—Cr—Al-based alloys have a deformation problem at high temperatures and improved oxidation resistance is required to help to improve the durability thereof. The present invention is intended to provide an Fe—Cr—Al-based alloy for catalyst carriers and a foil thereof having a thickness of 40 $\mu$m or less, the alloy and the foil improved in the oxidation resistance at high temperatures and having excellent deformation resistance. The material of the present invention is specifically suitable for catalytic converter materials and for instruments and apparatuses in combustion gas exhaust systems.

SUMMARY OF THE INVENTION

The inventors have found that the effective content of La depends on the foil thickness through close examinations of the contents of La, Zr, and Hf, the initial oxidation resistance, and the deformation resistance at high temperatures. The inventors reached a result that the thinner the foil thickness is, the more remarkable the effect is, and thus the present invention was completed.

A first aspect of the invention is an Fe—Cr—Al-based alloy foil comprising 0.07 mass % or less of C, 0.5 mass % or less of Si, 0.5 mass % of Mn, 16.0 to 25.0 mass % of Al, 0.05 mass % or less of N, La, Zr, and the balance being Fe and incidental impurities. The contents by mass % of La and Zr meet the following ranges when the foil thickness thereof is t $\mu$m:

$$1.4/t \leqq La \leqq 6.0/t \quad (1)$$

$$0.6/t \leqq Zr \leqq 4.0/t \quad (2)$$

A second aspect of the invention is the Fe—Cr—Al-based alloy foil according to the first aspect, further comprising Hf and the balance being Fe and incidental impurities, wherein the content by mass % of La, Zr, and Hf meet the following ranges:

$$1.4/t \leqq La \leqq 6.0/t \quad (1)$$

$$0.4/t \leqq Zr \leqq 2.0/t \quad (3)$$

$$0.5/t \leqq Hf \leqq 2.0/t \quad (4)$$

A third aspect of the invention is the Fe—Cr—Al-based alloy foil according to the first or the second aspects in which the final foil thickness is preferably 40 $\mu$m or less. A fourth aspect of the invention is the Fe—Cr—Al-based alloy foil according to the first, the second, or third aspects, further comprising lanthanoids other than La and Ce such that the contents thereof are each 0.001 to 0.05 mass % and totally 0.2 mass % or less. Such an alloy foil has excellent characteristics.

A fifth aspect of the invention is a favorable Fe—Cr—Al-based alloy foil according to the first to fourth aspects, in which the completed foil preferably has a structure of which the mean crystal grain size is 5 $\mu$m or less or a rolling structure. A sixth aspect of the invention is a method of manufacturing an Fe—Cr—Al-based alloy foil. The manufacturing method comprises preparing a molten steel comprising 0.07 mass % or less of C, 0.5 mass % or less of Si, 0.5 mass % of Mn, 16.0 to 25.0 mass % of Cr, 1 to 8 mass % of Al, 0.05 mass % or less of N, La, Zr, and the balance being Fe and incidental impurities in a molten state. The method also comprises: pouring the molten steel into a slab; perform hot rolling; perform annealing; and repeating cold rolling and annealing to form a foil. In this instance, the contents by mass % of La and Zr meet the following ranges when the foil thickness thereof is t $\mu$m:

$$1.4/t \leqq La \leqq 6.0/t \quad (1)$$

$$0.6/t \leqq Zr \leqq 4.0/t \quad (2)$$

A seventh aspect of the invention is the manufacturing method of an Fe—Cr—Al-based alloy foil according to the sixth aspects, in which the molten steel further comprises Hf and the contents by mass % of La, Zr, and Hf meet the following ranges:

$$1.4/t \leqq La \leqq 6.0/t \quad (1)$$

$$0.4/t \leqq Zr \leqq 2.0/t \quad (3)$$

$$0.5/t \leqq Hf \leqq 2.0/t \quad (4)$$

An eighth aspect of the invention is the manufacturing method of an Fe—Cr—Al-based alloy foil according to the sixth or seventh aspects, in which annealing before the final cold rolling is performed at a temperature of 700 to 1000° C.

In the manufacturing method of the Fe—Cr—Al-based alloy foil of the present invention, the annealing before the final cold rolling is performed at a temperature of 700 to 1000° C. in the foil production process.

BEST MODE FOR CARRYING OUT THE INVENTION

Figure 1:
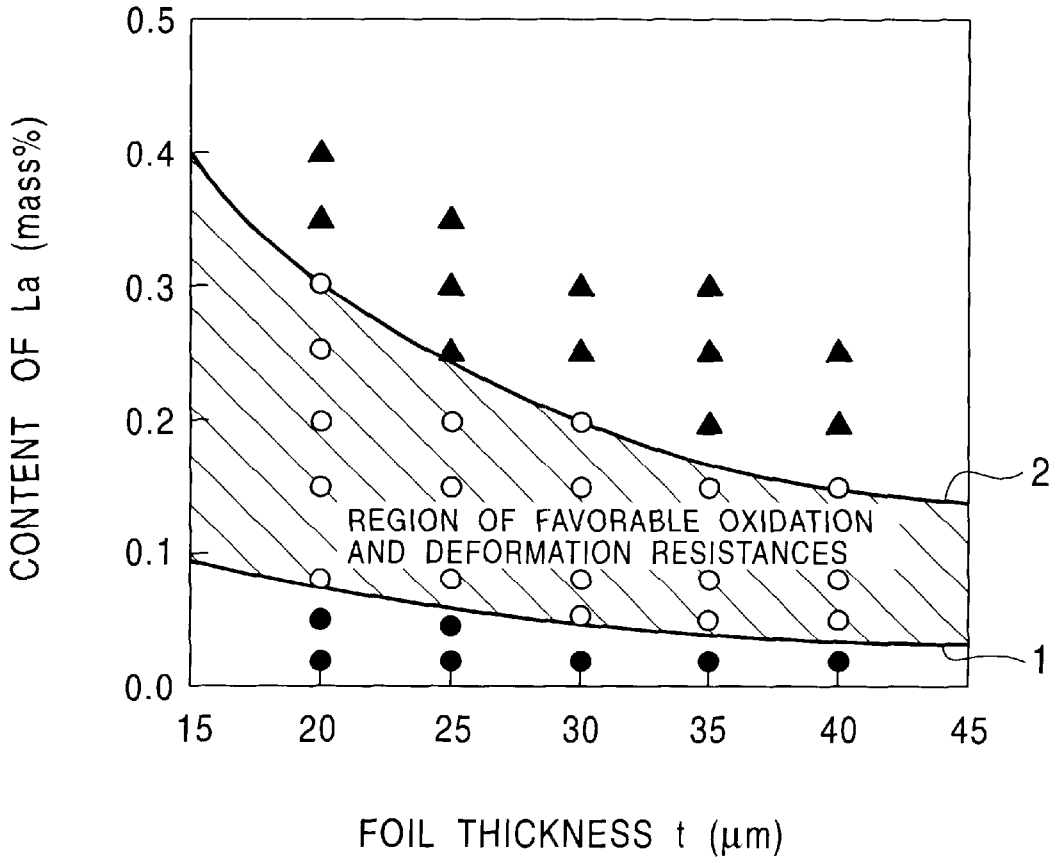
FIG. 1 is a graph showing the relationship between La content and the oxidation resistance at various foil thicknesses.

An alloy foil of the invention contains especially La and Zr. The foil may further contain Hf. Each component is adequately contained depending on the final foil thickness to improve oxidation and deformation resistances at high temperatures. The following are effects of the components and the reasons for determining the contents.

Al: 1 to 8 Mass %

Al is an essential element to ensure the oxidation resistance in the present invention. When the Fe—Cr—Al-based alloy remains at high temperatures, Al is oxidized prior to Fe and Cr to form an oxide film of $Al_2O_3$ which protects the alloy surface from oxidation, thereby improving the oxidation resistance. If the Al content is less than 1 mass %, a pure $Al_2O_3$ film cannot be formed, and consequently sufficient oxidation resistance cannot be ensured. The Al content therefore must be 1 mass % or more. Although increasing the Al content is advantageous in view of the oxidation resistance, more than 8 mass % of Al causes cracking and fracturing of plates or the like during hot rolling, thus making manufacturing difficult. The Al content therefore is limited to 1 to 8 mass %.

Cr: 16 to 25 Mass %

Cr contributes to an improvement in the oxidation resistance of Al, and also is itself oxidation resistant. If the Cr content is less than 16.0 mass %, the oxidation resistance cannot be ensured. In contrast, a Cr content of more than 25.0 mass % leads to lowered toughness, thus causing cracking and fracturing of plates during cold rolling. The Cr content is therefore in the range of 16.0 to 25.0 mass %.

Si: 0.5 Mass % or Less

Si, as well as Al, is an element which enhances the oxidation resistance of the alloy as in the case of Al, and therefore may be contained in the alloy. However, large Si content leads to lowered toughness. The upper limit of Si content is therefore 0.5 mass %.

Mn: 0.5 Mass % or Less

Mn may be contained as an auxiliary agent for the deoxidization of Al. However, a large amount of Mn remaining in the steel lead to decreased oxidation resistance and deteriorated corrosion resistance; hence the Mn content is preferably as low as possible. The Mn content is limited to 0.5 mass % or less in consideration of industrial and economical ingot production technique.

La, Zr, Hf:

La, Zr, and Hf are significantly important elements in the present invention. Oxidation of an Fe—Cr—Al-based alloy generally proceeds as follows: First, only an $Al_2O_3$ film preferentially grows in the early oxidation stage. When Al is completely consumed, this oxidation (hereinafter referred to as the first step) is completed. Next, when Al in the steel is depleted, the second step in which $Cr_2O_3$ grows between the $Al_2O_3$ film and the base alloy (hereinafter referred to as the second step) starts. Finally, the production of iron oxides starts, so that a value of weight increase by oxidation rapidly increases. This stage is the third step (hereinafter referred to as the third step).

Conventionally, in actual environment in which catalyst carriers are used, the oxidation of a foil having a thickness of more than 50 $\mu$m is completed at the first step. In contrast, a thinner foil often allows the oxidation to change to the second step relatively early in the actual environment because the absolute amount of Al in the steel is reduced. A foil having a thickness of 40 $\mu$m or less requires the oxidation resistance after the second step, which has been unnoticed.

La contributes to an improvement in the adhesion, to the base metal, of surface-oxidized films such as $Al_2O_3$ and $Cr_2O_3$ which are created at high temperature in the Fe—Cr—Al-based alloy and is remarkably effective in improving the oxidation resistance and the peeling resistance of oxidized scale. At the same time, La is also effective in lowering the oxidation rate of Al, hence being an essential element. Adding Zr with La inhibits the consumption of Al, thereby delaying the production times of $Al_2O_3$ and $Cr_2O_3$ films. Thus, Zr contributes to an improvement in the oxidation resistance of the alloy. Furthermore, adding Hf with La and Zr particularly inhibits the consumption of Al, thereby delaying the production times of $Al_2O_3$ and $Cr_2O_3$ films. Thus, Hf contributes to an improvement in the oxidation resistance of the alloy. At the same time, Hf inhibits the production of a $Cr_2O_3$ film, thereby reducing the amount of the deformation of the foil, which probably arises from a difference of thermal expansion coefficients between $Cr_2O_3$ and the base metal. Typically a thin material, such as a honeycomb, having a less elongation barely increases in the heat stress and hardly fractures; hence, it is a long-life material. The less the elongation is, the better it is, and the elongation is preferably about 3% or less.

According to intensive examination on the contents of La, Zr, and Hf, oxidation resistances thereof, especially the oxidation resistances at high temperatures in the second step, and the elongation, the inventors found that effective contents of La, Zr, and Hf depend on foil thicknesses.

As an example, the case of La will be described below. La contributes to an improvement in the adhesion, to the base metal, of surface-oxidized films such as $Al_2O_3$ and $Cr_2O_3$ which are formed at high temperatures in the Fe—Cr—Al-based alloy, as described above. This action is caused by diffusion of La in the direction of the foil thickness when the alloy is heated to a high temperature. The La content effective in improving the adhesion, to the base metal, of surface-oxidized films such as $Al_2O_3$ and $Cr_2O_3$ is probably determined according to unit surface area. Also, the absolute amount of La which diffuses in the direction of the thickness and then reaches the foil surface is probably proportional to the foil thickness. This means that the La content per unit volume must be increased in advance according to the reduced thickness in order to compensate for the amount of La diffusing in the direction of the thickness when heated to a high temperature because it is decreased according to the reduced thickness. This is because the thin thickness is likely to cause a shortage of the absolute amount of La diffusing in the direction of the thickness, so that the adhesion, to the base metal, of surface-oxidized films such as $Al_2O_3$ and $Cr_2O_3$ is not improved. However, this does not necessarily mean that the more La content is, the better the result will be. According to the degree of remaining La in the steel, which does not diffuse in the direction of the thickness when heated to a high temperature, La content is limited by itself. This is because if La remains in the steel, La itself is oxidized and this leads to a deterioration in oxidation resistance. FIG. 1 shows a result of a close examination of the relationship between La content (mass %) and the oxidation resistance in a thickness t ($\mu$m). This data is a result of a test in which foil specimens were heated in an air of 1200° C. for 150 hours.

As for the oxidation resistance, the specimens increasing in weight by oxidation by less than 10 g/m$^2$ are judged to be favorable. As for the deformation resistance, the specimens elongating by less than 3% in the second step are judged to be favorable. For each specimen exhibiting a favorable result in both the oxidation and the deformation resistances, a white circle is marked; for each specimen exhibiting an inferior result in both the oxidation and the deformation resistances, a black circle is marked; and for each specimen exhibiting a inferior result in only the deformation resistance, a black triangle is marked.

The La content causing satisfactory oxidation and deformation resistances lies in the region between Curve 1 for La=1.4/t and Curve 2 for La=6.0/t. According to FIG. 1, when the La content (mass %) is 1.4/t or more at a foil thickness t ($\mu$m), the oxidation resistance is favorable, and when the La content is 6.0/t or less, the elongation can be lowered in the second step. The La content of the present invention therefore is determined to be within the range meeting the following relational expression.

$$1.4/t \leqq La \leqq 6.0/t \quad (1)$$

Next, Zr and Hf contents are described below. When La and Zr are added, the following relational expression must be met.

$$0.6/t \leqq Zr \leqq 4.0/t \quad (2)$$

When La, Zr, and Hf are added, the following relational expressions must be met.

$$0.4/t \leqq Zr \leqq 2.0/t \quad (3)$$

$$0.5/t \leqq Hf \leqq 2.0/t \quad (4)$$

The inventors examined the diffusion behaviors of Hf and Zr in the oxidation steps, the components added together with La. The inventors found that when the foil is heated, Zr and Hf diffuse toward the interface between the $Al_2O_3$ film of the foil surface and the base metal in the early oxidation stage, and subsequently settle in the $Al_2O_3$ grain boundary of the $Al_2O_3$ film of the foil surface. Also, the inventors found that Zr and Hf settling in the grain boundary inhibit oxygen from diffusing into $Al_2O_3$ and $Al_2O_3$ from growing. The inventors further found that Hf and Zr settling in the $Al_2O_3$ grain boundary inhibit $Cr_2O_3$ from growing and decreases the oxidation rate in the second step. Although the reason is not yet clear, the inventors have found that Hf is more easily settled in the $Al_2O_3$ grain boundary than Zr is, and that adding Zr together with Hf is more effective than adding only Zr. The inventors also have found that when Hf and Zr are added in combination, Hf diffuses toward the $Al_2O_3$ grain boundary. The amount of Zr diffusing toward the $Al_2O_3$ grain boundary, therefore, must be lowered compared with the case of only Zr; otherwise, Zr would become oxides in the $Al_2O_3$ grain boundary and the oxidation resistance of the overall foil would be decreased.

As for the effect of the combination use of Zr and Hf on the oxidation resistance, when the contents of Zr and Hf are too low, they do not settle in the $Al_2O_3$ grain boundary in the early oxidation stage, so that the oxidation resistance is not adequately exhibited. In contrast, when the contents of Zr and Hf are significantly high, they are concentrated not only in the $Al_2O_3$ grain boundary but also at the interface between the scale and the base metal, and become oxides. The oxides serve as short-cut passages for oxygen. Thus, the oxidation rate is increased, and the oxidation resistance is decreased. In particular, this deterioration of the oxidation resistance becomes more severe in the second step, and at this time the elongation increases. The adequate amount depends on the surface area of oxidation, hence depending on the foil thickness. The reason is exactly the same as the reason described on La.

Figure 2:
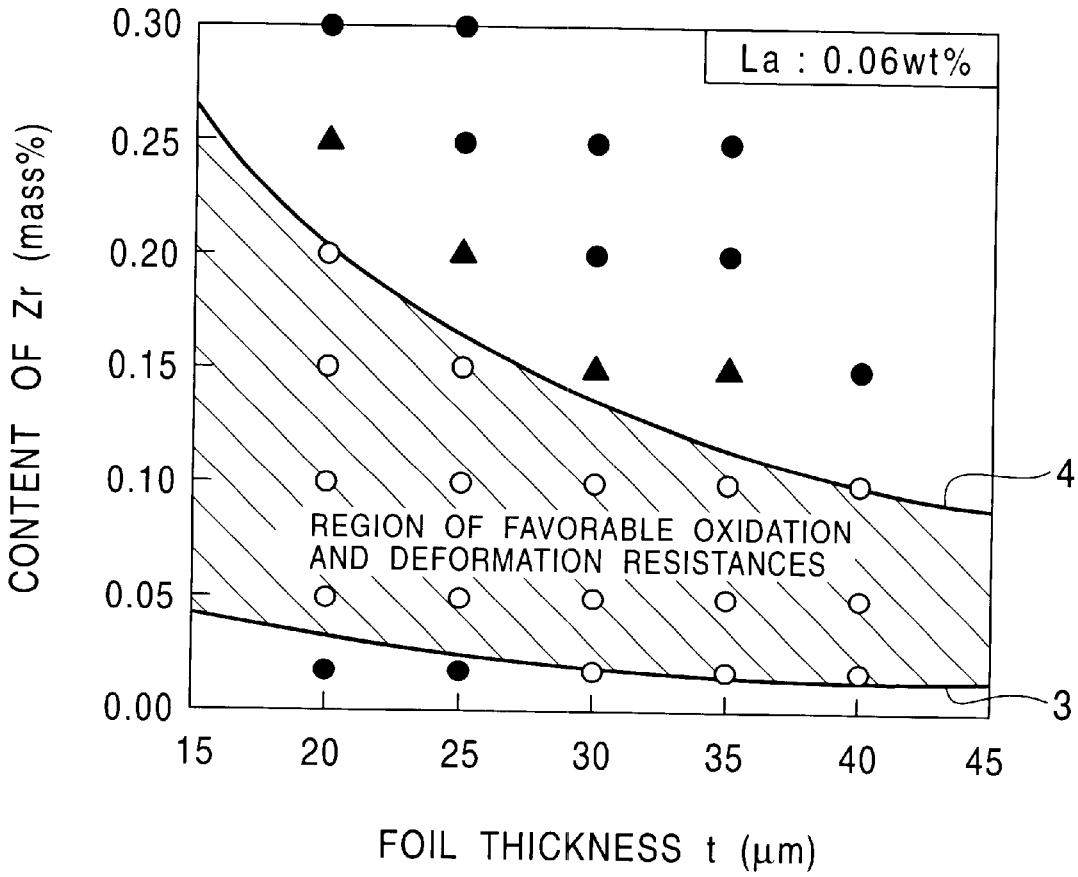
FIG. 2 is a graph showing the relationship between Zr content and the oxidation and the deformation resistances of foil containing 0.06 mass % of La at various thicknesses.

FIG. 2 shows the relationship between Zr content and the oxidation resistance of foil containing 0.06 mass % of La of various thicknesses. This data is a result of a test in which foil specimens were heated in air at 1200° C. for 150 hours.

As for the oxidation resistance, the specimens increasing in weight by oxidation by less than 10 g/m$^2$ are judged to be favorable. As for the deformation resistance, the specimens elongating by less than 3% in the second step are judged to be favorable. For each specimen exhibiting favorable oxidation and deformation resistances, a white circle is marked; for each specimen exhibiting inferior oxidation and deformation resistances, a black circle is marked; and for each specimen exhibiting only inferior deformation resistance, a black triangle is marked. The Zr content causing satisfactory oxidation and deformation resistances lies in the region between Curve 3 for Zr=0.6/t and Curve 4 for Zr=4.0/t.

Figure 3:
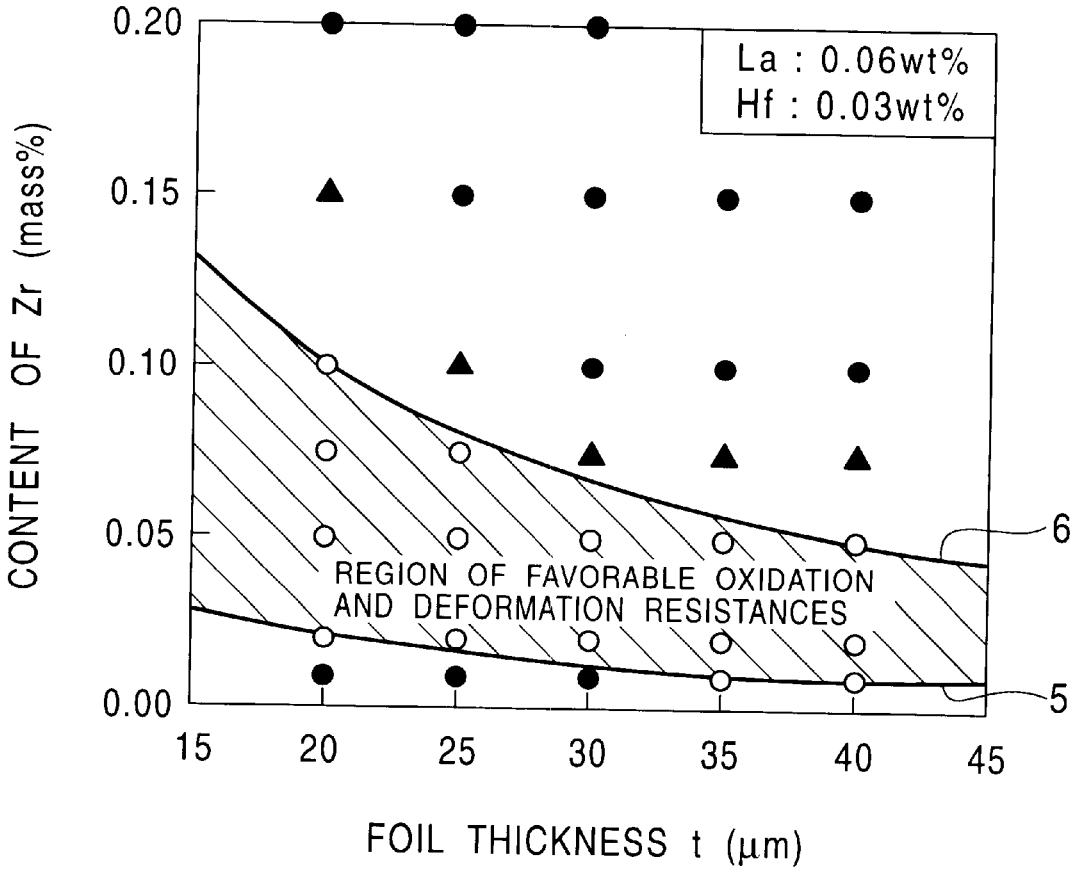
FIG. 3 is a graph showing the relationship between Zr content and the oxidation and the deformation resistances of foil containing 0.06 mass % of La and 0.03 mass % of Hf at various thicknesses.

FIG. 3 shows the relationship between Zr content and the oxidation resistance of foil containing 0.06 mass % of La and 0.03 mass % of Hf various thicknesses. This data is a result of a test in which foil specimens were heated in air at 1200° C. for 150 hours.

As for the oxidation resistance, the specimens increasing in weight by oxidation by less than 10 g/m$^2$ are judged to be favorable. As for the deformation resistance, the specimens elongating by less than 3% in the second step are judged to be favorable. For each specimen exhibiting favorable oxidation and deformation resistances, a white circle is marked; for each specimen exhibiting inferior oxidation and the deformation resistances, a black circle is marked; and for each specimen exhibiting only inferior deformation resistance, a black triangle is marked. The Zr content causing satisfactory oxidation and deformation resistances lies in the region between Curve 5 for Zr=0.4/t and Curve 6 for Zr=2.0/t.

Figure 4:
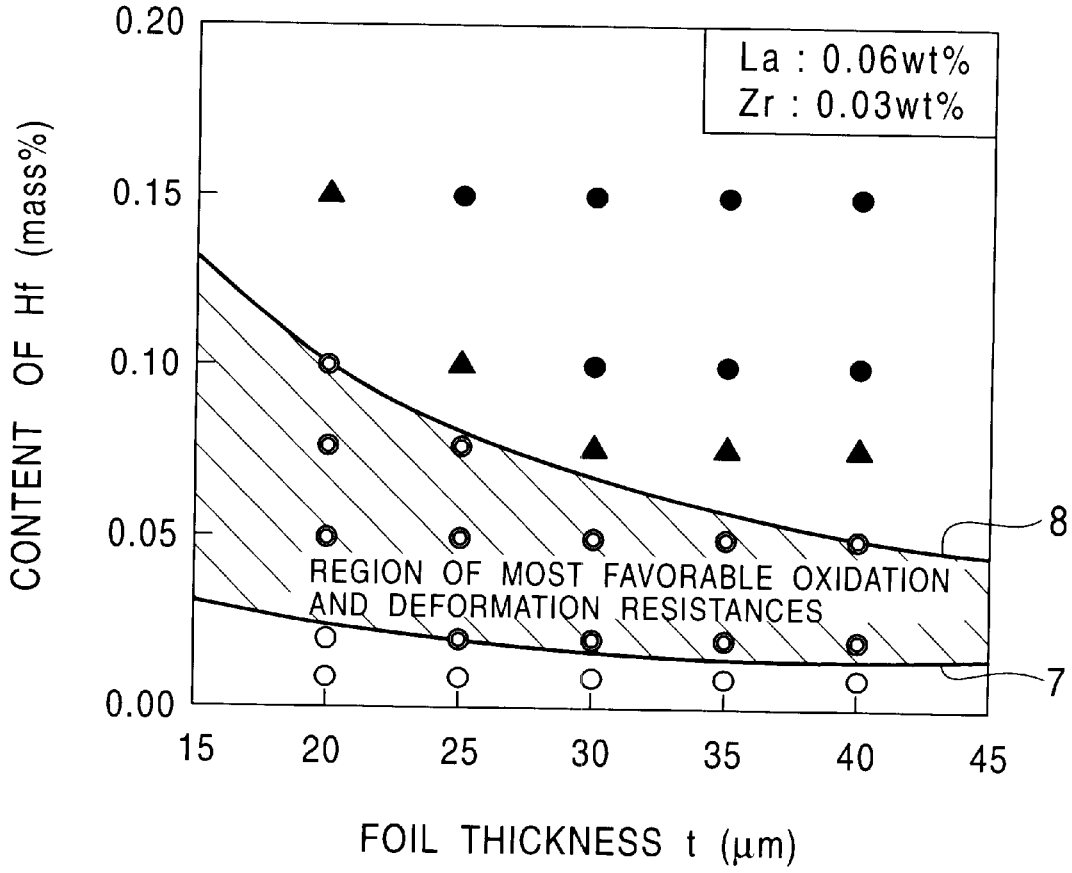
FIG. 4 is a graph showing the relationship between Hf content and the oxidation and the deformation resistances of foil containing 0.06 mass % of La and 0.03 mass % of Zr at various thicknesses.

FIG. 4 shows the relationship between Hf content and the oxidation and the deformation resistances of foil containing 0.06 mass % of La and 0.03 mass % of Zr of various thicknesses. This data is a result of a test in which foil specimens were heated in air at 1200° C. for 150 hours.

As for the oxidation resistance, the specimens increasing in weight by oxidation by less than 8 $g/m^2$, by 8 $g/m^2$ or more and less than 10 $g/m^2$, and by more than 10 $g/m^2$ are judged to be most favorable, favorable, and inferior, respectively. As for the deformation resistance, the specimens elongating by less than 3% in the second step are judged to be favorable. For each specimen exhibiting most favorable oxidation and deformation resistances, a double circle is marked; for each specimen exhibiting favorable oxidation and deformation resistances, a white circle is marked; for each specimen exhibiting inferior oxidation and deformation resistances, a black circle is marked; and for each specimen exhibiting only inferior deformation resistance, a black triangle is marked. The Hf content causing satisfactory oxidation and deformation resistances lies in the region between Curve 7 for Hf=0.5/t and Curve 8 for Hf=2.0/t.

According to FIGS. 1 to 4, preferably the Zr and Hf contents depend on foil thicknesses. When La and Zr are present, the Zr content is preferably within the range of the following relational expression:

$$0.6/t \leqq Zr \leqq 4.0/t \quad (2).$$

When La, Zr, and Hf are present, the Zr and Hf contents are preferably within the range of the following relational expressions:

$$0.4/t \leqq Zr \leqq 2.0/t \quad (3),$$

and $$0.5/t \leqq Hf \leqq 2.0/t \quad (4).$$

Thus, excellent oxidation resistance and less elongation (a deformation resistance) are exhibited. The contents of Zr and Hf therefore are specified as follows:

When La and Zr are present, $$0.6/t \leqq Zr \leqq 4.0/t \quad (2).$$

When La, Zr, and Hf are present, $$0.4/t \leqq Zr \leqq 2.0/t \quad (3)$$

and $$0.5/t \leqq Hf \leqq 2.0/t \quad (4).$$

C: 0.07 Mass % or Less

Excess content of C leads to decreased temperature strength, and also to decreased oxidation resistance and lowered toughness. The C content therefore is limited to 0.07 mass % or less.

N: 0.05 Mass % or Less

Excess content of N leads to lowered toughness in the same manner as C, and also causes cracking during cold rolling. Thus, the manufacturing becomes difficult and product workability is lowered. Also, if N reacts with Al and coarse AlN is precipitated, the oxidation resistance is decreased.

N content therefore is limited to 0.05 mass % or less.

Lanthanoids other than La and Ce: 0.001 to 0.05 Mass % Each and 0.2 Mass % or Less in Total Lanthanoids consist of fifteen metal elements having an atomic numbers from 57 to 71, such as La, Ce, and Nd, etc. Lanthanoids other than La and Ce improve the adhesion of oxide films produced on the foil surface, such as $Al_2O_3$ and $Cr_2O_3$, thereby contributing to an improvement in the oxidation resistance. Ce is excluded because it deteriorates the toughness, so that the plate easily cracks during hot rolling. Furthermore, Ce significantly lowers the oxidation resistance. Since La is generally contained together with other lanthanoids except Ce rather than purified from raw ore, the contents of lanthanoids except La and Ce can be each in the range of 0.001 to 0.05 mass %. To prevent the plate from cracking during hot rolling, the total content of lanthanoids except La and Ce is determined to be 0.2 mass % or less.

The components of the foil of the present invention are prepared in a molten state and poured to form steel ingot or a slab. After hot rolling and annealing, cold rolling and annealing are repeated so that a foil having a desired thickness of 40 $\mu$m or less is formed. The foil is wound on a coil. The annealing before the final rolling is performed at a temperature of 700 to 1000° C. This is because the inventors found that elemental La, Zr, Hf, and the like, which are main points of the invention, do not necessarily diffuse sufficiently and can localize in, for example, planar flow casting or the like, and that each element does not constantly exhibit the effects arising from meeting the relational expressions of the foil thickness.

In addition, if planar flow casting or the like is performed in a mass production, variations in product quality are exhibited wherein one part has a preferable oxidation resistance, while another does not. This is because rapid cooling in planar flow casting allows a part having a structure or a component which, on the basis of the phase diagram, are not expected to be formed. Thus, depending on the manufacturing method, some parts may have completely different characteristics; hence specified components do not necessarily result in a uniform oxidation-resistant foil because of the effect of variations of manufacturing conditions. Furthermore, the inventors found that it is effective to perform the annealing at a temperature of 700 to 1000° C. before the final cold rolling. This is because the elements do not sufficiently diffuse at temperatures of less than 700° C.; the thickness of the oxidized film of the surface increases at a temperature of more than 1000° C.; and thus descaling becomes difficult. The temperature for the annealing before the final cold rolling therefore is determined to be 700 to 1000° C., and preferably 800 to 950° C.

The annealing is preferably performed in a reducing atmosphere such as in ammonia cracked gas.

Preferably, the structure of a completed foil of the present invention has a mean crystal grain size of 5 $\mu$m or less or a rolling structure (meaning that the crystal has not been recrystallized by the final annealing but is in its natural state as rolled, hereinafter referred to as rolling structure). If the completed foil has a large crystal grain size or a columnar structure before being incorporated in a honeycomb, large deformation of the foil is caused during oxidation. In particular, the foil having a thickness of 40 $\mu$m or less causes Cr to be oxidized in the second step, thereby bringing about still larger deformation supposedly arising from a difference of expansion rate between chromium oxide and the base metal. However, if the foil structure has a mean crystal grain size of 5 $\mu$m or less or a rolling structure, foil shrinkage is caused by a deflection arising from a rolling force. The shrinkage is minimized in an oxidation stage progressed a certain degree and then the foil is expanded again. Thus, the smaller the initial structure of the foil is, the less the expansion rate is with respect to the size of the initial structure. This effect is exhibited in the case of a mean crystal grain size of 5 μm or less, and is especially remarkable in the rolling structure case. If the mean crystal grain size is more than 5 μm, the foil is expanded from the beginning of oxidation. The foil structure preferably has a mean crystal grain size of 5 μm or less or a rolling structure.

Also, the present invention is preferably applied to foils intended for use in completed products having a thickness of 40 μm or less. The foil having a thickness of 40 μm or less, more specifically 35 μm, is effective in that an exhaust back pressure is reduced by reducing the wall thickness of the metal carrier and that the temperature rises in a short period after engine start and rapidly reaches a temperature capable of activating a catalyst owing to the reduced heat capacity. It goes without saying that even foils having a thickness of more than 40 μm are oxidation resistant and are effective against the deformation in the second step as far as the compositions are within the description of the present invention. Nevertheless, having a thickness of 40 μm or less is remarkably effective in rapidly raising the temperature. The thickness is therefore preferably 40 μm or less, and more preferably 35 μm or less.

EXAMPLE 1

Tables 1 and 2 show the compositions of specimens. These materials were formed into ingots by vacuum melting. After being heated to 1200° C., each ingot was hot-rolled to be formed into a plate 3 mm thick at a temperature of 1200 to 900° C. Then, after annealing at 950° C., cold rolling and annealing were repeated until a foil 0.1 mm thick was formed. The foil was annealed at 900° C. for 1 min in ammonia cracked gas, and finally was cold-rolled to be formed into a foil having a thickness of 20 to 40 μm. Each foil specimen has a rolling structure.

Each foil specimen (50 mm×50 mm of rectangular foil) prepared as above was oxidized in air at 1100° C. for 500 hours and the oxidation resistance characteristics thereof were examined. Results are shown in Tables 3, 4, and 5. Corresponding to experimental run numbers 1 to 20 in Table 1, Table 3 shows results of the experiments in which La and Zr were added. The relationships between La and Zr contents each and the foil thickness in Table 3 are represented by left and right side values of the following expressions, respectively.

$$1.4/t \leqq La \leqq 6.0/t \quad (1)$$

$$0.6/t \leqq Zr \leqq 4.0/t \quad (2)$$

Corresponding to experimental run numbers 21 to 40 in Table 2, Table 4 and 5 show results of the experiments in which La, Zr, and Hf were added. The relationships between La and Zr contents each and the foil thickness in Table 4 are represented by left and right side values of the following expressions, respectively.

$$1.4/t \leqq La \leqq 6.0/t \quad (1)$$

$$0.4/t \leqq Zr \leqq 2.0/t \quad (3)$$

$$0.5/t \leqq Hf \leqq 2.0/t \quad (4)$$

In tables 3 and 5, weight increase, expansion rate, and observed oxides are shown. As for eight increase, a double circle, a white circle, a triangle, or a cross is marked for each specimen which increased in weight at ambient temperature after air cooling by less than 5.0 g/m$^2$, 5.0 g/m$^2$ or more and less than 8.0 g/m$^2$, 8.0 g/m$^2$ or more and less than 10.0 g/m$^2$, or otherwise, respectively. As for expansion rate, a double circle, a white circle, a triangle, or a cross is marked for each specimen of which a side length (50 mm) expanded after complete cooling by less than 1.0%, 1.0% or more and less than 2.0%, 2.0% or more and less than 3.0%, or 3.0% or more, respectively. Specimens exhibiting an expansion rate of less than 3.0% are judged to be acceptable. Observed oxides are oxides which were observed by an X-ray diffraction analysis after the oxidation test.

Steels within the description of the present invention having contents according to the foil thickness exhibited most favorable oxidation resistance. Furthermore, even in the case of a foil thickness of 40 μm or less, favorable oxidation resistance was exhibited. Even though specimens contained the same components, test results differed according to the foil thicknesses. In particular, when the La, Zr, and Hf contents were not specified for thin foils, the oxidation resistance decreased. Also, the elongation in the second step, which is important for foils having a thickness of 40 μm or less, was favorable. According to the results of X-ray diffraction analysis, steels containing an excess amount of any of La, Zr, and Hf with respect to the relational expressions deteriorated in the oxidation resistance, and particularly in the second step, because these elements resulted in oxides. Accordingly, the foil of the present invention is suitable for a material for catalytic converters requiring a most favorable oxidation resistance.

EXAMPLE 2

Table 6 shows compositions for test materials. Part of each composition was formed into an ingot by vacuum melting. After being heated to 1200° C., the ingot was hot-rolled to be formed into a plate 3 mm thick at a temperature of 1200 to 900° C. Then, after annealing at 950° C., cold rolling and annealing were repeated, so that a foil 0.1 mm thick was formed. The foil was annealed in ammonia cracked gas under the condition shown in Table 8, and finally was cold-rolled to be formed into a foil having a thickness of 20 to 40 μm. In addition, another part of the composition was provided with a finishing anneal in ammonia cracked gas so as resulting in a specimen having a structure with a different crystal grain size, and was used for the oxidation test. Still another part was formed into a foil having a predetermined thickness of 20 to 40 μm by planar flow casting and was used for the oxidation test. Each specimen was a rectangular foil with 50 mm×50 mm. The relationships between La, Zr, and Hf contents each and the foil thickness are represented by left and right side values of the following expressions, respectively.

$$1.4/t \leqq La \leqq 6.0/t \quad (1)$$

$$0.4/t \leqq Zr \leqq 2.0/t \quad (3)$$

$$0.5/t \leqq Hf \leqq 2.0/t \quad (4)$$

The specimens with various thicknesses each was used for the oxidation test at 1100° C. for 500 hours. Results are shown in Table 8. Table 8 shows conditions where the specimens were annealed before the final rolling, structures or mean crystal grain sizes of completed foil products, oxidation increase values, and expansion rate. The mean crystal grain size was obtained by an image analysis in accordance with JIS G0552 in which the structure in the section perpendicular to the rolling direction was observed with a microscope. In addition, planar flow cast ribbons are described in the table as comparative examples. As for weight increase, a double circle, a white circle, a triangle, or a cross is marked for each specimen which increased in weight at ambient temperature after air cooling by less than 5.0 g/m$^2$, 5.0 g/m$^2$ or more and less than 8.0 g/m$^2$, 8.0 g/m$^2$ or more and less than 10.0 g/m$^2$, or otherwise, respectively. As for expansion rate, a double circle, a white circle, a triangle, or a cross is marked for each specimen of which the longitudinal side length expanded after complete cooling by less than 1.0%, 1.0% or more and less than 2.0%, 2.0% or more and less than 3.0%, or 3.0% or more, respectively. Specimens exhibiting an expansion rate of less than 3.0% were judged to be acceptable.

Steels annealed before the final rolling as described in the present invention exhibit more favorable oxidation resistance. Furthermore, even in the case of a foil thickness of 40 $\mu$m or less, favorable oxidation resistance is exhibited. Even though specimens contain the same components, the oxidation resistance of specimens formed by repeated annealing is far more favorable than that of specimens formed by planar flow casting. While the specimens formed by planar flow casting are each partly more oxidation resistant than the specimens formed by hot rolling after casting and repeating annealing and cold rolling, they are not partly oxidation resistant and exhibit ununiform oxidation resistance in a foil. In addition, forming a foil of which the final crystal has a structure as described in the present invention allows the expansion rate to decrease. Accordingly, the foil of the present invention is suitable for a material for catalytic converters requiring a most favorable oxidation resistance.

Industrial Applicability

According to the present invention, an Fe—Cr—Al-based alloy containing La, Zr, and/or Hf according to the foil thickness thereof can result in a oxidation and deformation resistant alloy foil. The alloy of the present invention is suitable for a material for catalytic converters of automobiles, and more specifically the alloy formed into a foil having a thickness of 40 $\mu$m or less has excellent characteristics.

TABLE 1

| Experiment No. | Steel No. | Component (wt %) C | Si | Mn | Cr | Al | N | La | Zr | Hf | Lanthanoids except La and Ce |
|---|---|---|---|---|---|---|---|---|---|---|---|
| 1 | A | 0.005 | 0.10 | 0.10 | 20.2 | 5.8 | 0.004 | 0.052 | 0.025 | — | |
| 2 | B | 0.010 | 0.20 | 0.20 | 18.5 | 7.9 | 0.005 | 0.085 | 0.032 | — | |
| 3 | C | 0.025 | 0.22 | 0.09 | 20.3 | 5.6 | 0.004 | 0.069 | 0.050 | — | |
| 4 | D | 0.015 | 0.50 | 0.16 | 22.3 | 6.0 | 0.008 | 0.065 | 0.026 | — | Nd = 0.01, Sm = 0.05 |
| 5 | E | 0.010 | 0.30 | 0.20 | 20.5 | 3.0 | 0.007 | 0.058 | 0.018 | — | |
| 6 | F | 0.008 | 0.22 | 0.09 | 20.2 | 4.8 | 0.004 | 0.098 | 0.036 | — | |
| 7 | G | 0.028 | 0.25 | 0.16 | 24.5 | 5.5 | 0.008 | 0.065 | 0.045 | — | Sm = 0.01 |
| 8 | H | 0.007 | 0.20 | 0.20 | 16.5 | 6.2 | 0.005 | 0.125 | 0.120 | — | |
| 9 | I | 0.035 | 0.22 | 0.09 | 20.1 | 5.5 | 0.008 | 0.058 | 0.025 | — | Nd = 0.01 |
| 10 | J | 0.015 | 0.10 | 0.16 | 19.5 | 6.2 | 0.008 | 0.158 | 0.034 | — | Sm = 0.01 |
| 11 | K | 0.010 | 0.30 | 0.20 | 21.2 | 5.6 | 0.010 | 0.085 | 0.136 | — | |
| 12 | L | 0.025 | 0.10 | 0.09 | 18.5 | 5.6 | 0.004 | 0.039 | 0.025 | — | |
| 13 | M | 0.015 | 0.50 | 0.16 | 19.8 | 6.0 | 0.008 | 0.056 | 0.068 | — | |
| 14 | N | 0.010 | 0.10 | 0.20 | 20.3 | 4.5 | 0.012 | 0.172 | 0.052 | — | |
| 15 | O | 0.025 | 0.22 | 0.09 | 22.1 | 5.5 | 0.008 | 0.092 | 0.031 | — | |
| 16 | A | 0.005 | 0.10 | 0.10 | 20.2 | 5.8 | 0.004 | 0.052 | 0.025 | — | |
| 17 | E | 0.010 | 0.30 | 0.20 | 20.5 | 3.0 | 0.007 | 0.058 | 0.018 | — | |
| 18 | K | 0.010 | 0.30 | 0.20 | 21.2 | 5.6 | 0.010 | 0.085 | 0.136 | — | |
| 19 | P | 0.010 | 0.20 | 0.20 | 18.5 | 7.9 | 0.005 | 0.210 | 0.032 | — | Nd = 0.01 |
| 20 | Q | 0.025 | 0.22 | 0.09 | 22.1 | 5.5 | 0.008 | 0.092 | 0.175 | — | |

TABLE 2

| Experiment No. | Steel No. | Component (wt %) C | Si | Mn | Cr | Al | N | La | Zr | Hf | Lanthanoids except La and Ce |
|---|---|---|---|---|---|---|---|---|---|---|---|
| 21 | R | 0.004 | 0.16 | 0.10 | 21.0 | 5.8 | 0.005 | 0.065 | 0.021 | 0.025 | |
| 22 | S | 0.008 | 0.12 | 0.20 | 19.5 | 7.8 | 0.006 | 0.058 | 0.035 | 0.023 | |
| 23 | T | 0.015 | 0.15 | 0.09 | 16.5 | 6.5 | 0.007 | 0.185 | 0.023 | 0.038 | |
| 24 | U | 0.023 | 0.26 | 0.16 | 21.3 | 5.2 | 0.012 | 0.075 | 0.033 | 0.035 | Nd = 0.01, Sm = 0.05 |
| 25 | V | 0.030 | 0.25 | 0.20 | 18.9 | 3.0 | 0.008 | 0.128 | 0.050 | 0.052 | |
| 26 | W | 0.008 | 0.16 | 0.09 | 19.8 | 5.6 | 0.005 | 0.056 | 0.032 | 0.065 | |
| 27 | U | 0.005 | 0.21 | 0.16 | 24.2 | 5.9 | 0.004 | 0.065 | 0.067 | 0.030 | Sm = 0.01 |
| 28 | X | 0.003 | 0.35 | 0.20 | 18.9 | 5.6 | 0.006 | 0.085 | 0.015 | 0.025 | |
| 29 | Y | 0.012 | 0.50 | 0.09 | 16.2 | 6.2 | 0.007 | 0.092 | 0.045 | 0.062 | Nd = 0.01 |
| 30 | Z | 0.007 | 0.12 | 0.16 | 20.2 | 5.8 | 0.009 | 0.156 | 0.031 | 0.029 | Sm = 0.01 |
| 31 | AA | 0.008 | 0.13 | 0.20 | 20.3 | 6.0 | 0.010 | 0.112 | 0.018 | 0.015 | |
| 32 | AB | 0.012 | 0.15 | 0.09 | 18.5 | 4.8 | 0.012 | 0.045 | 0.025 | 0.052 | |
| 33 | AC | 0.016 | 0.25 | 0.16 | 21.5 | 6.5 | 0.007 | 0.098 | 0.045 | 0.035 | |
| 34 | AD | 0.008 | 0.12 | 0.20 | 22.2 | 4.3 | 0.011 | 0.076 | 0.054 | 0.025 | |
| 35 | AE | 0.025 | 0.13 | 0.09 | 19.4 | 5.6 | 0.008 | 0.082 | 0.062 | 0.037 | |

TABLE 2-continued

| Experiment No. | Steel No. | Component (wt %) C | Si | Mn | Cr | Al | N | La | Zr | Hf | Lanthanoids except La and Ce |
|---|---|---|---|---|---|---|---|---|---|---|---|
| 36 | T | 0.015 | 0.15 | 0.09 | 16.5 | 6.5 | 0.007 | 0.185 | 0.023 | 0.038 | |
| 37 | X | 0.003 | 0.35 | 0.20 | 18.9 | 5.6 | 0.006 | 0.085 | 0.015 | 0.025 | |
| 38 | AA | 0.008 | 0.13 | 0.20 | 20.3 | 6.0 | 0.010 | 0.112 | 0.018 | 0.015 | |
| 39 | Y | 0.012 | 0.50 | 0.09 | 16.2 | 6.2 | 0.007 | 0.092 | 0.045 | 0.062 | Nd = 0.01 |
| 40 | AE | 0.025 | 0.13 | 0.09 | 19.4 | 5.6 | 0.008 | 0.082 | 0.062 | 0.037 | |

TABLE 3

| Experimen No. | Foil thickness (μm) | La Left side of (1) | La Right side of (1) | Zr Left side of (2) | Zr Right side of (2) | Wt. by oxidation | Expansion rate | Observed oxides | Remark |
|---|---|---|---|---|---|---|---|---|---|
| 1 | 30 | 0.047 | 0.200 | 0.020 | 0.133 | ○ | ○ | α-$Al_2O_3$, $Cr_2O_3$ | Example |
| 2 | 39 | 0.036 | 0.154 | 0.015 | 0.103 | ○ | ◎ | α-$Al_2O_3$, $Cr_2O_3$ | Example |
| 3 | 21 | 0.067 | 0.286 | 0.029 | 0.190 | ○ | ○ | α-$Al_2O_3$, $Cr_2O_3$ | Example |
| 4 | 27 | 0.052 | 0.222 | 0.022 | 0.148 | ○ | ○ | α-$Al_2O_3$, $Cr_2O_3$ | Example |
| 5 | 35 | 0.040 | 0.171 | 0.017 | 0.114 | ○ | ○ | α-$Al_2O_3$, $Cr_2O_3$ | Example |
| 6 | 30 | 0.047 | 0.200 | 0.020 | 0.133 | ○ | ○ | α-$Al_2O_3$, $Cr_2O_3$ | Example |
| 7 | 25 | 0.056 | 0.240 | 0.024 | 0.160 | ○ | ○ | α-$Al_2O_3$, $Cr_2O_3$ | Example |
| 8 | 29 | 0.048 | 0.207 | 0.021 | 0.138 | ○ | ○ | α-$Al_2O_3$, $Cr_2O_3$ | Example |
| 9 | 31 | 0.045 | 0.194 | 0.019 | 0.129 | ○ | ○ | α-$Al_2O_3$, $Cr_2O_3$ | Example |
| 10 | 25 | 0.056 | 0.240 | 0.024 | 0.160 | ○ | ○ | α-$Al_2O_3$, $Cr_2O_3$ | Example |
| 11 | 26 | 0.054 | 0.231 | 0.023 | 0.154 | ○ | ○ | α-$Al_2O_3$, $Cr_2O_3$ | Example |
| 12 | 38 | 0.037 | 0.158 | 0.016 | 0.105 | ○ | ◎ | α-$Al_2O_3$, $Cr_2O_3$ | Example |
| 13 | 35 | 0.040 | 0.171 | 0.017 | 0.114 | ○ | ◎ | α-$Al_2O_3$, $Cr_2O_3$ | Example |
| 14 | 33 | 0.042 | 0.182 | 0.018 | 0.121 | ○ | ○ | α-$Al_2O_3$, $Cr_2O_3$ | Example |
| 15 | 26 | 0.054 | 0.231 | 0.023 | 0.154 | ○ | ○ | α-$Al_2O_3$, $Cr_2O_3$ | Example |
| 16 | 25 | 0.056 | 0.240 | 0.024 | 0.160 | Δ | Δ | α-$Al_2O_3$, $Cr_2O_3$ | Comparative Example |
| 17 | 28 | 0.050 | 0.214 | 0.021 | 0.143 | x | Δ | α-$Al_2O_3$, $Cr_2O_3$ | Comparative Example |
| 18 | 36 | 0.039 | 0.167 | 0.017 | 0.111 | x | x | α-$Al_2O_3$, $Cr_2O_3$, $ZrO_2$ | Comparative Example |
| 19 | 30 | 0.047 | 0.200 | 0.020 | 0.133 | ○ | x | α-$Al_2O_3$, $Cr_2O_3$, $La_2O_3$ | Comparative Example |
| 20 | 25 | 0.056 | 0.240 | 0.024 | 0.160 | x | x | α-$Al_2O_3$, $Cr_2O_3$, $ZrO_2$ | Comparative Example |

La + Zr Contained
$1.4/t \leqq La \leqq 6.0/t$ . . . (1)
$0.6/t \leqq Zr \leqq 4.0/t$ . . . (2)

TABLE 4

| Experimen No. | Foil thickness (μm) | La Left side of (3) | La Right side of (3) | Zr Left side of (4) | Zr Right side of (4) | Hf Left side of (5) | Hf Right side of (5) |
|---|---|---|---|---|---|---|---|
| 21 | 30 | 0.047 | 0.200 | 0.013 | 0.067 | 0.017 | 0.067 |
| 22 | 39 | 0.036 | 0.154 | 0.010 | 0.051 | 0.013 | 0.051 |
| 23 | 21 | 0.067 | 0.286 | 0.019 | 0.095 | 0.024 | 0.095 |
| 24 | 27 | 0.052 | 0.222 | 0.015 | 0.074 | 0.019 | 0.074 |
| 25 | 35 | 0.040 | 0.171 | 0.011 | 0.057 | 0.014 | 0.057 |
| 26 | 30 | 0.047 | 0.200 | 0.013 | 0.067 | 0.017 | 0.067 |
| 27 | 25 | 0.056 | 0.240 | 0.016 | 0.080 | 0.020 | 0.080 |
| 28 | 35 | 0.040 | 0.171 | 0.011 | 0.057 | 0.014 | 0.057 |
| 29 | 25 | 0.056 | 0.240 | 0.016 | 0.080 | 0.020 | 0.080 |
| 30 | 25 | 0.056 | 0.240 | 0.016 | 0.080 | 0.020 | 0.080 |
| 31 | 39 | 0.036 | 0.154 | 0.010 | 0.051 | 0.013 | 0.051 |
| 32 | 38 | 0.037 | 0.158 | 0.011 | 0.053 | 0.013 | 0.053 |
| 33 | 35 | 0.040 | 0.171 | 0.011 | 0.057 | 0.014 | 0.057 |
| 34 | 33 | 0.042 | 0.182 | 0.012 | 0.061 | 0.015 | 0.061 |
| 35 | 26 | 0.054 | 0.231 | 0.015 | 0.077 | 0.019 | 0.077 |
| 36 | 35 | 0.040 | 0.171 | 0.011 | 0.057 | 0.014 | 0.057 |
| 37 | 25 | 0.056 | 0.240 | 0.016 | 0.080 | 0.020 | 0.080 |
| 38 | 30 | 0.047 | 0.200 | 0.013 | 0.067 | 0.017 | 0.067 |
| 39 | 35 | 0.040 | 0.171 | 0.011 | 0.057 | 0.014 | 0.057 |
| 40 | 38 | 0.037 | 0.158 | 0.011 | 0.053 | 0.013 | 0.053 |

La + Zr + Hf Contained
$1.4/t \leqq La \leqq 6.0/t$ . . . (1)
$0.4/t \leqq Zr \leqq 2.0/t$ . . . (3)
$0.5/t \leqq Hf \leqq 2.0/t$ . . . (4)

TABLE 5

| Experimen No. | Wt. by oxidation | Expansion rate | Observed oxides | Remark |
|---|---|---|---|---|
| 21 | ◎ | ◎ | $\alpha$-$Al_2O_3$, $Cr_2O_3$ | Example |
| 22 | ◎ | ◎ | $\alpha$-$Al_2O_3$ | Example |
| 23 | ◎ | ◎ | $\alpha$-$Al_2O_3$, $Cr_2O_3$ | Example |
| 24 | ◎ | ◎ | $\alpha$-$Al_2O_3$, $Cr_2O_3$ | Example |
| 25 | ◎ | ◎ | $\alpha$-$Al_2O_3$ | Example |
| 26 | ◎ | ◎ | $\alpha$-$Al_2O_3$, $Cr_2O_3$ | Example |
| 27 | ◎ | ◎ | $\alpha$-$Al_2O_3$, $Cr_2O_3$ | Example |
| 28 | ◎ | ◎ | $\alpha$-$Al_2O_3$, $Cr_2O_3$ | Example |
| 29 | ◎ | ◎ | $\alpha$-$Al_2O_3$, $Cr_2O_3$ | Example |
| 30 | ◎ | ◎ | $\alpha$-$Al_2O_3$, $Cr_2O_3$ | Example |
| 31 | ◎ | ◎ | $\alpha$-$Al_2O_3$, $Cr_2O_3$ | Example |
| 32 | ◎ | ◎ | $\alpha$-$Al_2O_3$ | Example |
| 33 | ◎ | ◎ | $\alpha$-$Al_2O_3$ | Example |
| 34 | ◎ | ◎ | $\alpha$-$Al_2O_3$, $Cr_2O_3$ | Example |

TABLE 5-continued

| Experimen No. | Wt. by oxidation | Expansion rate | Observed oxides | Remark |
|---|---|---|---|---|
| 35 | ◎ | ◎ | $\alpha$-$Al_2O_3$, $Cr_2O_3$ | Example |
| 36 | ○ | x | $\alpha$-$Al_2O_3$, $Cr_2O_3$, $La_2O_3$ | Comparative example |
| 37 | x | Δ | $\alpha$-$Al_2O_3$, $Cr_2O_3$ | Comparative example |
| 38 | Δ | x | $\alpha$-$Al_2O_3$, $Cr_2O_3$ | Comparative example |
| 39 | x | Δ | $\alpha$-$Al_2O_3$, $Cr_2O_3$, $HfO_2$ | Comparative example |
| 40 | x | x | $\alpha$-$Al_2O_3$, $Cr_2O_3$, $ZrO_2$ | Comparative example |

TABLE 6

| Steel No. | Component | | | | | | | | | |
|---|---|---|---|---|---|---|---|---|---|---|
| | C | Si | Mn | Cr | Al | N | La | Zr | Hf | Lanthanoids except La and Ce |
| AF | 0.005 | 0.10 | 0.10 | 20.2 | 5.8 | 0.004 | 0.071 | 0.032 | 0.031 | |
| AG | 0.007 | 0.20 | 0.23 | 17.8 | 7.2 | 0.005 | 0.085 | 0.045 | 0.015 | |
| AH | 0.012 | 0.10 | 0.09 | 24.8 | 5.6 | 0.004 | 0.058 | 0.025 | 0.055 | |
| AI | 0.003 | 0.30 | 0.16 | 20.5 | 6.0 | 0.008 | 0.115 | 0.028 | 0.042 | Nd = 0.01 |

TABLE 7

| Steel No. | Foil thickness ($\mu$m) | La | | Zr | | Hf | | Remark |
|---|---|---|---|---|---|---|---|---|
| | | Left side of (3) | Right side of (3) | Left side of (4) | Right side of (4) | Left side of (5) | Right side of (5) | |
| AF | 29 | 0.048 | 0.207 | 0.014 | 0.069 | 0.017 | 0.069 | Example |
| AG | 38 | 0.037 | 0.158 | 0.011 | 0.053 | 0.013 | 0.053 | Example |
| AH | 25 | 0.056 | 0.240 | 0.016 | 0.080 | 0.020 | 0.080 | Example |
| AI | 21 | 0.067 | 0.286 | 0.019 | 0.095 | 0.024 | 0.095 | Example |

La + Zr + Hf Contained $1.4/t \leqq La \leqq 6.0/t$ . . . (1)

$0.4/t \leqq Zr \leqq 2.0/t$ . . . (3)

$0.5/t \leqq Hf \leqq 2.0/t$ . . . (4)

TABLE 8

| No. | Steel ingot | Foil thickness ($\mu$m) | Anneal before final rolling | | Finishing anneal | | Structure/ mean crystal grain size | Other note | Wt. increase by oxidation | Expansion rate | Observed oxides | Remark |
|---|---|---|---|---|---|---|---|---|---|---|---|---|
| | | | Annealing temp. (° C.) | Soaking time (s) | Annealing temp. (° C.) | Soaking time (s) | | | | | | |
| 41 | AF | 29 | 900 | 60 | — | — | Rolling | — | ◎ | ◎ | $\alpha$-$Al_2O_3$ | Example |
| 42 | | | 550 | 60 | — | — | Rolling | — | ○ | ○ | $\alpha$-$Al_2O_3$, $Cr_2O_3$ | Example |
| 43 | | | 850 | 60 | 950 | 60 | 5 $\mu$m | — | ◎ | ◎ | $\alpha$-$Al_2O_3$ | Example |
| 44 | | | 800 | 60 | 1100 | 60 | 20 $\mu$m | — | ○ | ○ | $\alpha$-$Al_2O_3$, $Cr_2O_3$ | Example |
| 45 | | | — | — | — | — | Amorphous | planar flow cast ribbon | Δ | x | $\alpha$-$Al_2O_3$, $La_2O_3$ | Comparative Example |
| 46 | AG | 38 | 800 | 150 | — | — | Rolling | — | ◎ | ◎ | $\alpha$-$Al_2O_3$ | Example |
| 47 | | | 400 | 30 | — | — | Rolling | — | ○ | ○ | $\alpha$-$Al_2O_3$, $Cr_2O_3$ | Example |
| 48 | | | 850 | 60 | 700 | 60 | 2 $\mu$m | — | ◎ | ◎ | $\alpha$-$Al_2O_3$ | Example |
| 49 | | | 900 | 30 | 1050 | 60 | 15 $\mu$m | — | ○ | ○ | $\alpha$-$Al_2O_3$, $Cr_2O_3$ | Example |

TABLE 8-continued

| No. | Steel ingot | Foil thickness (μm) | Anneal before final rolling: Annealing temp. (° C.) | Anneal before final rolling: Soaking time (s) | Finishing anneal: Annealing temp. (° C.) | Finishing anneal: Soaking time (s) | Structure/ mean crystal grain size | Other note | Wt. increase by oxidation | Expansion rate | Observed oxides | Remark |
|---|---|---|---|---|---|---|---|---|---|---|---|---|
| 50 | | | — | — | — | — | Amorphous | planar flow cast ribbon | Δ | x | α-$Al_2O_3$, $Cr_2O_3$, $La_2O_3$ | Comparative Example |
| 51 | AH | 25 | 950 | 60 | — | — | Rolling | — | ⊙ | ⊙ | α-$Al_2O_3$ | Example |
| 52 | | | 650 | 20 | — | — | Rolling | — | ○ | ○ | α-$Al_2O_3$, $Cr_2O_3$ | Example |
| 53 | | | 850 | 60 | 920 | 60 | 3 μm | — | ⊙ | ⊙ | α-$Al_2O_3$ | Example |
| 54 | | | 750 | 50 | 1000 | 60 | 8 μm | — | ○ | ○ | α-$Al_2O_3$, $Cr_2O_3$ | Example |
| 55 | | | — | — | — | — | Amorphous | planar flow cast ribbon | Δ | x | α-$Al_2O_3$, $Cr_2O_3$, $La_2O_3$ | Comparative Example |
| 56 | AI | 21 | 750 | 30 | — | — | Rolling | — | ⊙ | ⊙ | α-$Al_2O_3$ | Example |
| 57 | | | 600 | 60 | — | — | Rolling | — | ○ | ○ | α-$Al_2O_3$, $Cr_2O_3$ | Example |
| 58 | | | 950 | 30 | 900 | 60 | 1 μm | — | ⊙ | ⊙ | α-$Al_2O_3$ | Example |
| 59 | | | 850 | 50 | 1030 | 60 | 12 μm | — | ○ | ○ | α-$Al_2O_3$, $Cr_2O_3$ | Example |
| 60 | | | — | — | — | — | Amorphous | planar flow cast ribbon | Δ | x $La_2O_3$ | α-$Al_2O_3$, | Comparative Example |

What is claimed is:

1. An Fe—Cr—Al-based alloy foil comprising 0.07 mass % or less of C, 0.5 mass % or less of Si, 0.5 or less mass % of Mn, 16.0 to 25.0 mass % of Cr, 1 to 8 mass % of Al, 0.05 mass % or less of N, La, Zr, and the balance being Fe and incidental impurities, wherein the contents by mass % of said La and said Zr meet the following ranges when the foil thickness thereof is t μm:

$$1.4/t \leqq La \leqq 6.0/t \quad (1)$$

$$0.6/t \leqq Zr \leqq 4.0/t \quad (2), \text{ and}$$

wherein the foil thickness is 40 μm or less.

2. An Fe—Cr—Al-based alloy foil according to claim 1, further comprising Hf and the balance being Fe and incidental impurities, wherein the contents by mass % of said La, said Zr, and said Hf meet the following ranges:

$$1.4/t \leqq La \leqq 6.0/t \quad (1)$$

$$0.4/t \leqq Zr \leqq 2.0/t \quad (3)$$

$$0.5/t \leqq Hf \leqq 2.0/t \quad (4).$$

3. An Fe—Cr—Al-based alloy foil according to claim 1, further comprising lanthanoids other than La and Ce so that the contents thereof are each 0.001 to 0.05 mass % and total 0.2 mass % or less.

4. An Fe—Cr—Al-based alloy foil according to claim 1, wherein the foil has a structure of which the mean crystal grain size is 5 μm or less.

5. A method of manufacturing an Fe—Cr—Al-based alloy foil, comprising: preparing a molten steel comprising 0.07 mass % or less of C, 0.5 mass % or less of Si, 0.5 mass % or less of Mn, 16.0 to 25.0 mass % of Cr, 1 to 8 mass % of Al, 0.05 mass % or less of N, La, Zr, and the balance being Fe and incidental impurities in a molten state; pouring the molten steel to form a slab; performing hot rolling; performing annealing; and repeating cold rolling and annealing to form a foil, wherein the contents by mass % of said La and said Zr meet the following ranges when the foil thickness thereof is t μm:

$$1.4/t \leqq La \leqq 6.0/t \quad (1)$$

$$0.6/t \leqq Zr \leqq 4.0/t \quad (2), \text{ and}$$

wherein the foil thickness is 40 μm or less.

6. A method of manufacturing an Fe—Cr—Al-based alloy foil according to claim 5, wherein the molten steel further comprises Hf so that the contents by mass % of said La, said Zr, and said Hf meet the following ranges:

$$1.4/t \leqq La \leqq 6.0/t \quad (1)$$

$$0.4/t \leqq Zr \leqq 2.0/t \quad (3)$$

$$0.5/t \leqq Hf \leqq 2.0/t \quad (4).$$

7. A method of manufacturing an Fe—Cr—Al-based alloy foil according to claim 5, wherein the annealing before the final cold rolling is performed at a temperature of 700 to 1000° C.

8. An Fe—Cr—Al-based alloy foil comprising 0.07 mass % or less of C, 0.5 mass % or less of Si, 0.5 or less mass % of Mn, 16.0 to 25.0 mass % of Cr, 1 to 8 mass % of Al, 0.05 mass % or less of N, La, Zr, and the balance being Fe and incidental impurities, wherein the contents by mass % of said La and said Zr meet the following ranges when the foil thickness thereof is tμm:

$$1.4/t \leqq La \leqq 6.0/t \quad (1)$$

$$0.6/t \leqq Zr \leqq 4.0/t \quad (2), \text{ and}$$

wherein the foil has a rolling structure.

9. An Fe—Cr—Al-based alloy foil according to claim 8, wherein the foil thickness thereof is 40 μm or less.

10. An Fe—Cr—Al-based alloy foil according to claim 8, further comprising Hf and the balance being Fe and incidental impurities, wherein the contents by mass % of said La, said Zr, and said Hf meet the following ranges:

$$1.4/t \leqq La \leqq 6.0/t \quad (1)$$

$$0.4/t \leqq Zr \leqq 2.0/t \quad (3)$$

$$0.5/t \leqq Hf \leqq 2.0/t \quad (4).$$

11. An Fe—Cr—Al-based alloy foil according to claim 8, further comprising lanthanoids other than La and Ce so that the contents thereof are each 0.001 to 0.05 mass % and total 0.2 mass % or less.

12. A method of manufacturing an Fe—Cr—Al-based alloy foil, comprising: preparing a molten steel comprising 0.07 mass % or less of C, 0.5 mass % or less of Si, 0.5 mass % or less of Mn, 16.0 to 25.0 mass % of Cr, 1 to 8 mass % of Al, 0.05 mass % or less of N, La, Zr, and the balance being Fe and incidental impurities in a molten state; pouring the molten steel to form a slab; performing hot rolling; performing annealing; and repeating cold rolling to form a foil, wherein the contents by mass % of said La and said Zr meet the following ranges when the foil thickness thereof is t $\mu$m:

$$1.4/t \leqq La \leqq 6.0/t \quad (1)$$

$$0.6/t \leqq Zr \leqq 4.0/t \quad (2),$$

wherein the foil has a rolling structure.

13. A method of manufacturing an Fe—Cr—Al-based alloy foil according to claim 12, wherein the annealing before the final cold rolling is performed at a temperature of 700 to 1000° C.

* * * * *

UNITED STATES PATENT AND TRADEMARK OFFICE

CERTIFICATE OF CORRECTION

PATENT NO. : 6,719,855 B2
DATED : April 13, 2004
INVENTOR(S) : Fukuda et al.

It is certified that error appears in the above-identified patent and that said Letters Patent is hereby corrected as shown below:

Column 2,
Line 18, please change “25.0” to -- 25.00 --, and before “Al” please insert -- Cr, 1 to 8 mass % of --.

Column 18,
Table 8-continued, at No. 60, at the subheading “Expansion rate”, please delete “$La_2O_3$”.

Signed and Sealed this

Twenty-first Day of December, 2004

JON W. DUDAS
*Director of the United States Patent and Trademark Office*